US008109770B2

(12) United States Patent
Perugini et al.

(10) Patent No.: US 8,109,770 B2
(45) Date of Patent: Feb. 7, 2012

(54) HIGH SPEED, HIGH DENSITY INTERCONNECTION DEVICE

(75) Inventors: Michael N. Perugini, Monroe, CT (US); Gary D. Eastman, North Kingstown, RI (US); Alfred J. Langon, Cranston, RI (US); Raymond A. Prew, Foster, RI (US); Erol D. Saydam, Foster, RI (US)

(73) Assignee: Advanced Interconnections Corp., West Warwick, RI (US)

( * ) Notice: Subject to any disclaimer, the term of this patent is extended or adjusted under 35 U.S.C. 154(b) by 963 days.

(21) Appl. No.: 11/397,334

(22) Filed: Apr. 4, 2006

(65) Prior Publication Data

US 2006/0240688 A1 Oct. 26, 2006

Related U.S. Application Data

(63) Continuation of application No. 10/820,296, filed on Apr. 8, 2004, now Pat. No. 7,021,945, which is a continuation of application No. 10/178,957, filed on Jun. 24, 2002, now Pat. No. 6,743,049.

(51) Int. Cl.
*H01R 12/00* (2006.01)

(52) U.S. Cl. ..... 439/74; 439/607.12

(58) Field of Classification Search ..... 439/74, 439/607, 608, 607.12; 361/704
See application file for complete search history.

(56) References Cited

U.S. PATENT DOCUMENTS

| | | | |
|---|---|---|---|
| 3,904,265 | A | 9/1975 | Hollyday et al. |
| 4,239,318 | A | 12/1980 | Schwartz |
| 4,433,886 | A | 2/1984 | Cassarly et al. |
| 4,449,778 | A | 5/1984 | Lane |
| 4,718,866 | A | 1/1988 | Yamaguchi |
| 4,789,357 | A | 12/1988 | Yamaguchi et al. |
| 4,808,126 | A | 2/1989 | Wilson |
| 4,898,546 | A | 2/1990 | Elco et al. |

(Continued)

FOREIGN PATENT DOCUMENTS

| | | |
|---|---|---|
| JP | 62-88383 | 6/1987 |

(Continued)

OTHER PUBLICATIONS

Douglass Brooks, "Differential Impedance: What's the Difference?" *Printed Circuit Design.* Aug. 1998, Atlanta, U.S.A.

(Continued)

*Primary Examiner* — Michael Zarroli
(74) *Attorney, Agent, or Firm* — Occhiuti Rohlicek & Tsao LLP

(57) ABSTRACT

An intercoupling component for receiving an array of contacts within a digital or analog transmission system having an electrical ground circuit and chassis ground circuit, the intercoupling component may include a segment formed of electrically insulative material and having an upper and lower surface, the segment including a plurality of holes disposed on its upper surface and arranged in a predetermined footprint, one or more a shield members formed of electrically conductive material disposed within the segment and configured to connect to the chassis ground circuit of the system and a frame formed of electrically conductive material and configured to connect with the chassis ground circuit of the system. The intercoupling component may include an array of electrically conductive contacts grouped to multi-contact groupings configured to transmit single-ended or differential signals. The intercoupling component may include a cavity located between signal contacts to adjust the differential impedance between signal contacts.

30 Claims, 11 Drawing Sheets

U.S. PATENT DOCUMENTS

| | | | | |
|---|---|---|---|---|
| 4,909,743 | A | 3/1990 | Johnson et al. | |
| 4,938,704 | A | 7/1990 | Fujiura | |
| 4,974,075 | A | 11/1990 | Nakajima | |
| 5,055,069 | A | 10/1991 | Townsent et al. | |
| 5,133,679 | A | 7/1992 | Fusselman et al. | |
| 5,135,405 | A | 8/1992 | Fusselman et al. | |
| 5,256,086 | A | 10/1993 | Ponn | |
| 5,282,268 | A | 1/1994 | Mieras et al. | |
| 5,292,256 | A | 3/1994 | Brunker et al. | |
| 5,310,354 | A | 5/1994 | Oswald, Jr. | |
| 5,331,505 | A | 7/1994 | Wilheim | |
| 5,344,341 | A | 9/1994 | Yoshino | |
| 5,360,349 | A | 11/1994 | Provencher et al. | |
| 5,403,206 | A | 4/1995 | McNamara et al. | |
| 5,409,400 | A | 4/1995 | Davis | |
| 5,588,851 | A | 12/1996 | Morlion et al. | |
| 5,607,326 | A | 3/1997 | McNamara et al. | |
| 5,672,064 | A | 9/1997 | Provencher et al. | |
| 5,702,255 | A | 12/1997 | Murphy et al. | |
| 5,748,449 | A | 5/1998 | Tahmassebpur | |
| 5,795,191 | A | 8/1998 | Preputnick et al. | |
| 5,969,944 | A | 10/1999 | Borkar et al. | |
| 5,993,259 | A | 11/1999 | Stokoe et al. | |
| 5,997,361 | A | 12/1999 | Driscoll et al. | |
| 6,011,691 | A * | 1/2000 | Schreffler | 361/704 |
| 6,206,729 | B1 | 3/2001 | Bradley et al. | |
| 6,213,787 | B1 | 4/2001 | Murphy | |
| 6,234,827 | B1 | 5/2001 | Nishio et al. | |
| 6,281,715 | B1 | 8/2001 | DeClue et al. | |
| 6,290,535 | B1 | 9/2001 | Lin et al. | |
| 6,293,827 | B1 | 9/2001 | Stokoe | |
| 6,325,644 | B1 | 12/2001 | Lemke et al. | |
| 6,350,134 | B1 | 2/2002 | Fogg et al. | |
| 6,371,773 | B1 | 4/2002 | Crofoot et al. | |
| 6,482,038 | B2 * | 11/2002 | Olson | 439/608 |
| 6,506,076 | B2 * | 1/2003 | Cohen et al. | 439/608 |
| 6,533,613 | B1 | 3/2003 | Turner et al. | |
| 6,554,647 | B1 | 4/2003 | Cohen et al. | |
| 6,628,524 | B1 | 9/2003 | Washino et al. | |
| 6,635,958 | B2 | 10/2003 | Bates et al. | |
| 6,699,048 | B2 | 3/2004 | Johnson et al. | |
| 6,739,885 | B2 | 5/2004 | Ward et al. | |
| 6,747,216 | B2 | 6/2004 | Brist et al. | |
| 6,776,629 | B2 | 8/2004 | Shuey | |
| 6,843,657 | B2 | 1/2005 | Driscoll et al. | |
| 6,981,883 | B2 | 1/2006 | Raistrick et al. | |
| 2001/0040050 | A1 | 11/2001 | Sumida et al. | |
| 2001/0046810 | A1 | 11/2001 | Cohen et al. | |
| 2002/0119701 | A1 | 8/2002 | Olson | |
| 2002/0125967 | A1 | 9/2002 | Garrett et al. | |
| 2003/0022555 | A1 | 1/2003 | Vicich et al. | |
| 2004/0084207 | A1 | 5/2004 | Sievenpiper et al. | |

FOREIGN PATENT DOCUMENTS

| | | |
|---|---|---|
| JP | 05-275139 | 10/1993 |
| JP | 05-283126 | 10/1993 |
| JP | 06-506315 | 7/1994 |
| JP | 09-283247 | 10/1997 |
| JP | 10-162909 | 6/1998 |
| JP | 2000-50783 | 6/2000 |
| JP | 2002-513502 | 5/2002 |
| JP | 2002-270303 | 9/2002 |
| JP | 2002-313498 | 10/2002 |
| WO | 92/14281 | 8/1992 |
| WO | 97/36349 | 10/1997 |
| WO | 98/11633 | 3/1998 |
| WO | 00/31832 | 6/2000 |
| WO | 01/76015 | 10/2001 |
| WO | 02/27598 | 5/2002 |
| WO | 2004/001907 | 12/2003 |

OTHER PUBLICATIONS

National Semiconductor, *LVDS Owners Manual: A General Guide for National's Low Voltage Differential Signalling* (*LVDS*) *and Bus LVDS Products*. 2nd ed. Spring, 2000.

Bishop & Associates, Connector Business is Getting Better, The Bishop Report, Issue No. 131, vol. 4Q03, pp. 7-9, Oct. 2003.

* cited by examiner

HIGH SPEED, HIGH DENSITY INTERCONNECTION DEVICE

PRIORITY CLAIM

This application is a continuation of Ser. No. 10/820,296, filed Apr. 8, 2004, now U.S. Pat. No. 7,021,945, issued Apr. 4, 2006, which is a continuation of Ser. No. 10/178,957, filed Jun. 24, 2002, now U.S. Pat. No. 6,743,049, issued Jun. 1, 2004. The entire contents of both patents are incorporated herein by reference.

CROSS REFERENCE TO RELATED APPLICATIONS

This application is related to U.S. Pat. No. 6,899,550, issued May 31, 2005.

TECHNICAL FIELD

This description relates to interconnection devices, and more particularly to interconnection devices which connect an array of contacts within a digital or analog transmission system.

BACKGROUND

High speed communication between two printed circuit cards over an interconnection device with a dense array of contacts may result in cross-talk between communication channels within the interconnection device and a resulting degradation of signal integrity. In addition to cross-talk between communication channels, high speed communication across an interconnection device may generate undesirable levels of noise. Reduction of cross-talk and noise while at the same time maintaining a dense array of contacts within an interconnection device is often a design goal.

SUMMARY

In an aspect, the invention features an intercoupling component for receiving an array of contacts within a digital or analog transmission system having an electrical ground circuit and a chassis ground circuit. A plurality of electrically conductive contacts are disposed within holes formed on a segment formed of insulative material. One or more electrically conductive shields are disposed within the segment and are configured to connect to the chassis ground circuit of the system.

Embodiments may include one or more of the following. At least some of the plurality of the electrically conductive contacts disposed within the holes on the segment may be configured to electrically connect with the electrical ground circuit of the system.

A frame formed of electrically conductive material may surround the segment and be in electrical contact with both the shield member and the electrical ground circuit of the system. The frame may be molded around the segments.

One or more ground planes which are configured to electrically connect with the electrical ground circuit of the system may be disposed within the segment. One or more cavities filled with air may be disposed on the segment.

The intercoupling component may further include a retention member configured to releasably retain an array mating of contacts with the plurality of electrically conductive contacts.

In another aspect, the invention features an intercoupling component for receiving an array of contacts within a digital or analog transmission system having an electrical ground circuit and a chassis ground circuit. A plurality of electrically conductive contacts are disposed within holes formed on a plurality of segments, each formed of insulative material. One or more electrically conductive shields are disposed within gaps between adjacent segments and are connected to the chassis ground circuit of the system.

In another aspect, the invention features an intercoupling component for receiving an array of contacts within a digital or analog transmission system having one or more segments formed of electrically insulative material and having an upper and lower surface, the segment including a plurality of holes disposed on its upper surface and arranged in a predetermined footprint corresponding to the array of a contacts and a plurality of electrically conductive contacts each disposed within each hole on the upper surface of the segment. The plurality of contacts are arranged in a plurality of multi-contact groupings, with at least one multi-contact grouping including a first electrically conductive contact and a reference contact. The reference contact is located at a distance D from the first electrically conductive contact and is configured to electrically connect to the electrical ground circuit of the system.

Embodiments may include one or more of the following. The first electrically conductive contact and reference may be configured to form a transmission line electrically equivalent to a co-axial transmission line. The first electrically conductive contact may be configured to transmit single-ended signals. Additionally, each multi-contact grouping may be located a distance of $\geqq$D from adjacent multi-contact groupings.

The intercoupling component may also include a second electrically conductive contact member located at a distance D2 from the first electrically conductive contact. The first and second electrically conductive contacts may form a transmission line electrically equivalent to a twin-axial differential transmission line. The first and second electrically conductive contacts within each multi-contact grouping may be configured to transmit disparate single-ended signals or low-voltage differential signals. Additionally, each multi-contact grouping may be located a distance$\geqq$D2 from adjacent multi-contact groupings.

The first and second electrically conductive contacts may have substantially the same cross-section, initial characteristic impedance, capacitance, and inductance.

The intercoupling component may also include one or more shield members formed of electrically conductive material disposed within the segment and configured to connect to the chassis ground circuit of the system. Additionally, the intercoupling component may include a frame disposed around the one or more segments.

In another aspect of the invention, a circuit card for use in a digital or analog transmission system having an electrical ground circuit and a chassis ground circuit, the circuit card includes a printed circuit board having a plurality of contact pads arranged in a predetermined footprint; and an interconnection device. The interconnection device includes one or more segments having an upper and lower surface, the upper surface of the segment having a plurality of holes arranged in a predetermined footprint to match the predetermined footprint of the plurality of surface mount pads, a plurality of electrically conductive contact member disposed within each of the holes and electrically connected to their respective surface mount pad, and one or more a shield members formed of electrically conductive material disposed within the segment. Additionally, a frame formed of electrically conductive material surrounds the one or more segments and the frame is electrically connected the shield member and to the chassis ground circuit of the system.

Additional embodiments include one or more of the following features. The plurality of contacts may be arranged in a plurality of multi-contact groupings which includes a first electrically conductive contact; and a reference contact located at a distance D from the first electrically conductive contact and connected to the electrical ground circuit of the system.

The plurality of multi-contact groupings may also include a second electrically conductive contact located a distance D2 from the first electrically conductive contact.

The first and second electrically conductive contacts have substantially the same cross-section, capacitance and inductance. The first and second electrically conductive contacts may be configured to transmit low voltage differential signals or disparate single ended signals.

In another aspect of the invention, an intercoupling component for receiving an array of contacts within a digital or analog transmission system having an electrical ground circuit, the intercoupling component includes a segment formed of a material having a dielectric constant Er1. The segment has an upper and lower surface and a plurality of holes are disposed on the upper surface of the segment. A first signal contact disposed within a first hole on the segment and a second signal contact disposed within a second hole on the segment adjacent to the first hole in which the first signal contact is disposed. The segment also includes a cavity formed between the first and second signal contacts.

Additional embodiments include one or more of the following features. The cavity may be formed on the upper surface, lower surface or within the segment and may be is open to air. An insert formed of a material having a dielectric constant of Er2 may be disposed within the cavity.

The intercoupling component may include a plurality of first signal contacts disposed within a plurality of holes and a plurality of second signal contacts each disposed within a hole that is adjacent to a hole containing a first signal contact. The segment may include a cavity disposed between each pair of first and second signal contacts. The intercoupling component may also include ground contacts disposed within holes on the segment or a ground plane.

In another aspect of the invention, a method for adjusting the differential impedance of a pair of differential transmission lines in a interconnection device for receiving an array of contacts within a digital or analog transmission system having an electrical ground circuit, the intercoupling component. The method includes providing a segment having a dielectric constant Er1 and having an upper and lower surface and including a plurality of holes disposed on its upper surface. Providing a pair of signal contacts disposed within two adjacent holes on the segment, the pair of signal contacts configured to transmit differential signals. Spacing the pair of signal contacts such that they create a certain differential impedance of the two contacts in the pair of signal contacts. Providing a cavity in the segment between the two signal contacts in the pair of signal contacts to adjust the differential impedance between the pair of signal contacts.

Additional embodiments include one or more of the following steps. Inserting a material having a dielectric constant of Er2 in the cavity in the segment.

Providing a plurality of pairs of signal contacts disposed with a plurality of adjacent holes on the segment, the plurality of pairs of signal contacts forming an array of pairs of signal contacts disposed in the segment. Providing a plurality of cavities disposed in the segment between the two signal contacts in each pair of signal contacts to adjust the differential impedance of the two signal contacts in each pair of signal contacts.

Providing a plurality of ground contacts disposed within a plurality of holes on the segment and within the array of pairs of signal contacts, the plurality of ground contacts electrically connected to the electrical ground circuit of the system.

Providing a ground plane disposed within the segment and within the array of pairs of signal contacts, the ground plane configured to electrically connect with the electrical ground of the system.

Embodiments of the invention may have one or more of the following advantages.

One or more contacts disposed within the array of contacts and are configured to connect to the electrical ground of the system may help to reduce cross-talk between two or more contacts during signal transmission. Additionally, the use of a electrically conductive shield member connected to the chassis ground of the system and disposed within or between one or more segments may help to reduce undesired electromagnetic fields generated by high-speed electron flow over the contact array during operation.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
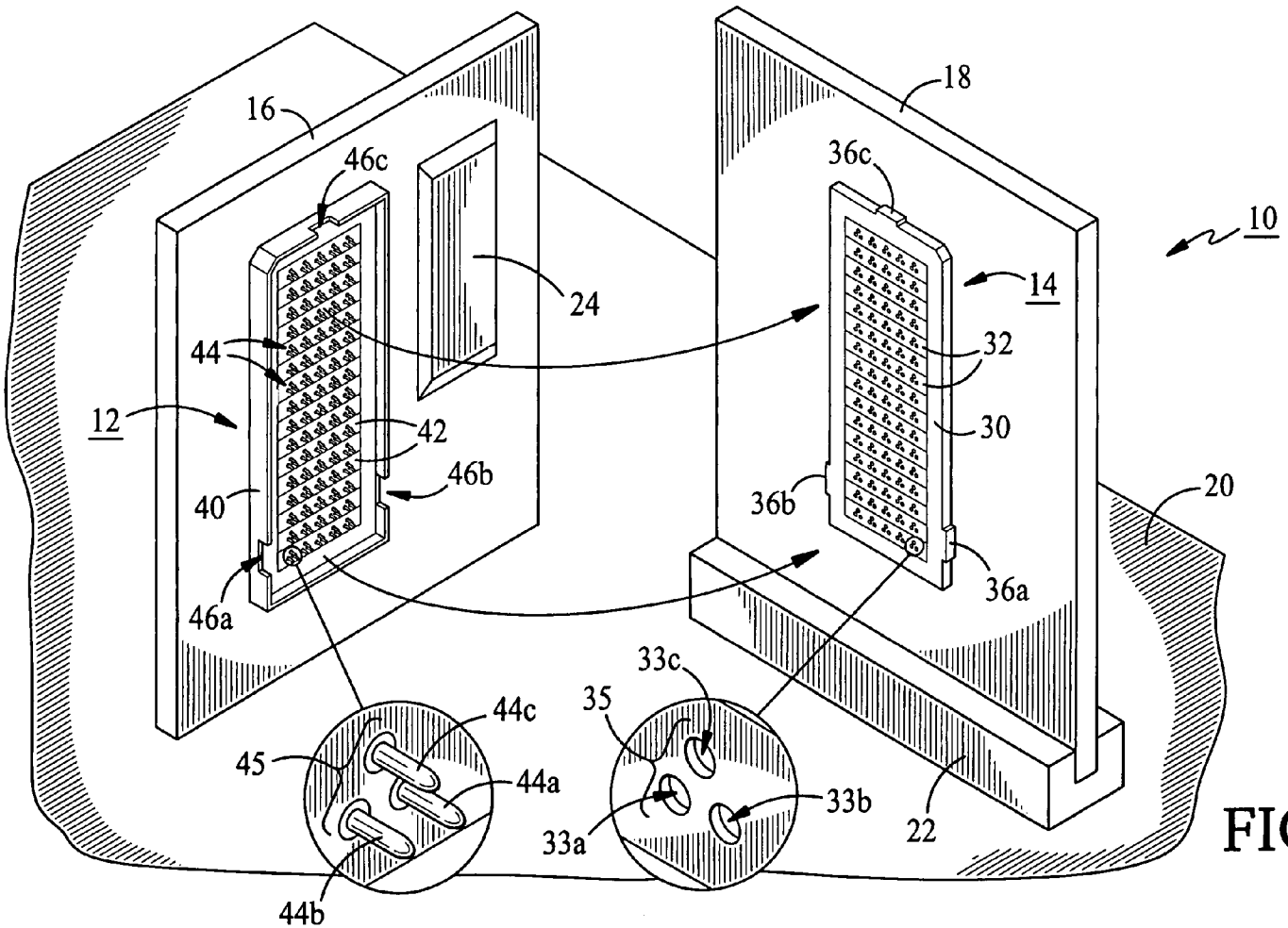
FIG. 1 is a is a perspective view, partially exploded, of an plug on a secondary circuit board and a matching socket on a primary circuit board within an digital or analog signal transmission system.

Referring to FIG. 1, in a digital or analog signal transmission system 10, a plug 12 and matching socket 14 releasably connect two printed circuit boards, a primary circuit board 18 and a secondary circuit board 16.

Digital or analog transmission system 10 may be any system which transmits digital or analog signals over one or more transmission lines, such as a computer system (as illustrated in FIG. 1), a telephony switch, a multiplexor/demultiplexor (MUX/DMUX), or a LAN/WAN cross-connect/router.

Secondary circuit board 16 may include a central processing unit (CPU), application specific integrated circuit (ASIC), memory, or similar active or passive devices and components. In this example, secondary circuit board 16 includes an ASIC device 24, and primary circuit board 18 is a daughter board connected to a motherboard 20 by a card slot connector 22. In another embodiment, the primary circuit board may be a self-contained system or board, not connecting to any other system or motherboard, as in the case of a single board computer.

The socket 14 includes a frame 30 formed of electrically conductive material that surrounds a number of segments 32. The segments 32 are formed of electrically insulative material. A shield (not shown in FIG. 1) formed of electrically conductive material is located between each of the segments 32 and is in electrical contact with the frame 30, thus forming an electrically conductive "cage" around the perimeter of each segment 32. As will be explained in greater detail below, the frame 30 is electrically connected to the chassis ground circuit (shown in FIG. 6) of the system 10.

The socket 14 has an array of holes arranged in a series of three-hole groupings 35 on each segment 32. A female socket assembly 34 (not shown in FIG. 1) is located within each of the holes 33*a*-33*c* and is configured to releasably receive a male pin. As will be explained in greater detail below, the three-contact grouping 35 includes a first signal contact (disposed within hole 33*a*), a second signal contact (disposed within hole 33*b*) and a reference contact (disposed within hole 33*c*). The reference contact is electrically connected to the electrical ground circuit (Vcc) (shown in FIG. 6) of the system 10.

Plug 12, which mates with socket 14, also includes a frame 40 formed of electrically conductive material that surrounds a number of segments 42. Like the socket segments 32, the plug segments 42 are formed of electrically insulative material. A shield (not shown in FIG. 1) formed of electrically conductive material is located between each of the segments 42 and is in electrical contact with the frame 40, thus forming an electrically conductive "cage" around the perimeter of each segment 42 within the plug 12. As will be explained more below, the frame 40 is electrically connected to the chassis ground circuit (shown in FIG. 6) of the system 10.

The plug 12 has an array of male pins 44 arranged in a series of three-pin groupings 45 on each segment 42. Each three-pin grouping 45 includes a first signal pin 44*a*, a second signal pin 44*b* and a reference pin 44*c*. As will be explained in greater detail below, these three pins mate with their respective sockets to form a twin-axial communication channel and a reference ground return between the plug 12 and socket 14.

Each of the male pins 44 protrude from the upper surface of the segments 42 and are received by the matching array of female sockets (not shown) disposed within each of the holes 34 on the socket 14. Each male pin and female socket attach to a solder ball (not shown in FIG. 1) that protrudes from the bottom surface of the plug 12 and socket 14, respectively, and is mounted via a solder reflow process to contact pads on the respective printed circuit boards, 16, 18. Thus, when the plug 12 is inserted into the socket 14, an electrical connection is formed between the secondary circuit board 16 and primary circuit board 18. In separate embodiments, the male pins 44 and female sockets 34 may not be terminated by a solder reflow process using solder balls, but may employ other methods for mounting the pins or sockets to a printed circuit card, such as through-hole soldering, surface mount soldering, through-hole compliant pin, or surface pad pressure mounting.

The plug frame 40 includes three guide notches 46*a*, 46*b*, 46*c* which mate with the three guide tabs 36*a*, 36*b*, 36*c* on the socket frame 30 in order to ensure proper orientation of the plug 12 and the socket 14 when mated together.

Figure 2A:
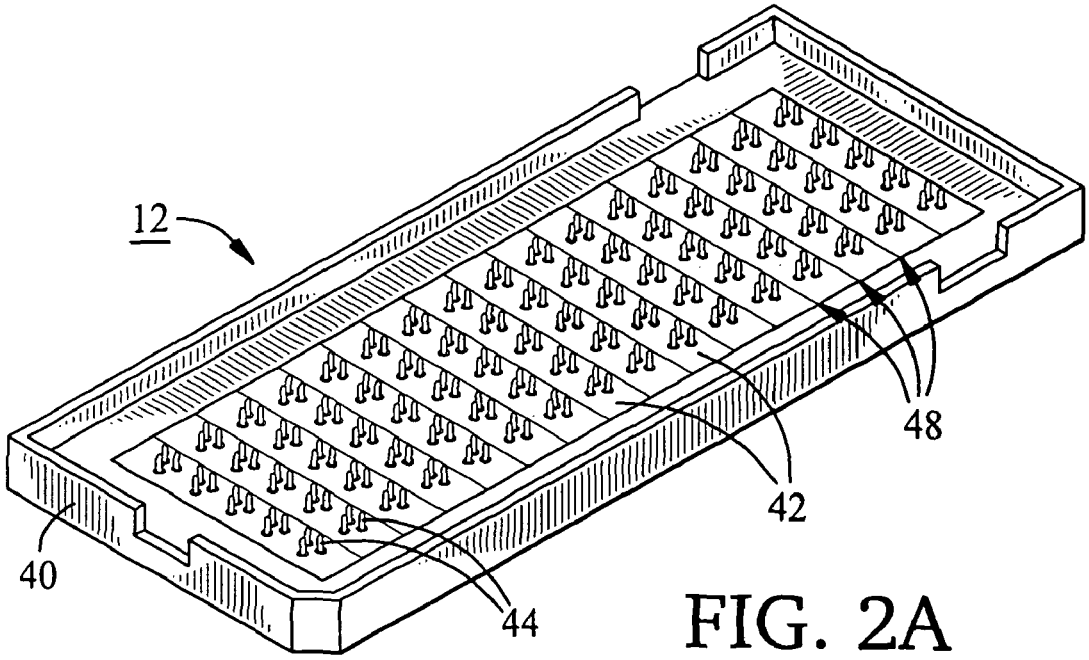
FIG. 2A is a perspective view of a plug.
Figure 2B:
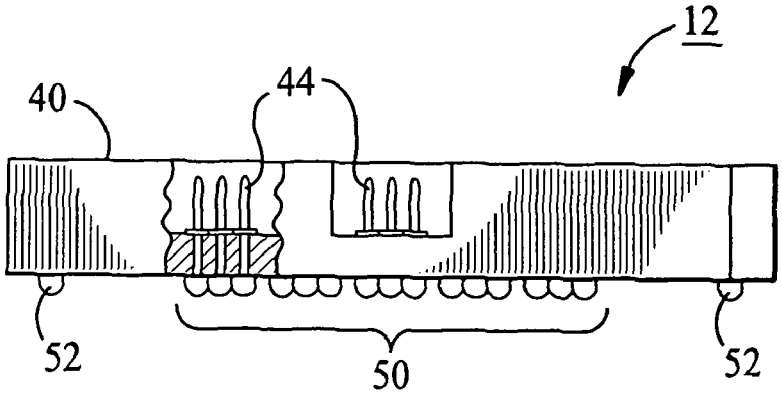
FIG. 2B is a side view of a plug, partially cut away.

Referring to FIGS. 2A-B, each male pin 44 extends from the lower surface of the plug 12 and protrudes from the upper surface of the segments 42. A solder ball 50 is attached (e.g., by soldering) to the terminal end of each male pin 44 and protrudes from the bottom surface of the plug. The array of solder balls 50 attached to the terminal end of each male pin 44 may be mounted (e.g., by a solder reflow process) to contact pads located on the secondary circuit board 16.

The plug frame 40 is formed of electrically conductive material and includes solder balls 52 are attached (e.g., by a solder reflow process) to the bottom surface of the plug frame 40. When the plug 14 is mounted to the secondary circuit board 16, the solder balls 52 attached to the plug frame 40 are electrically connected to the chassis ground circuit of the system 10.

Figure 3A:
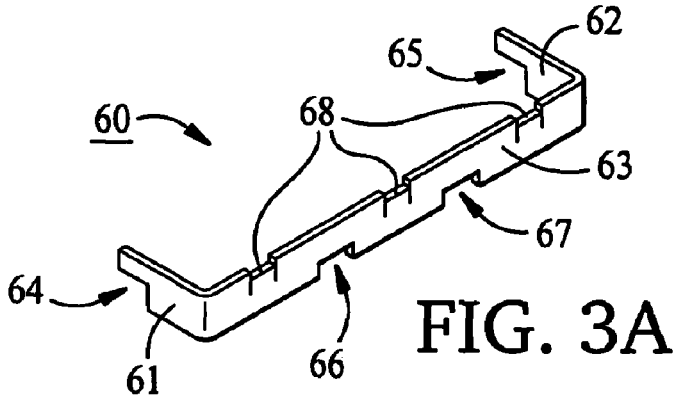
FIG. 3A is a perspective view of a plug shield.
Figure 3B:
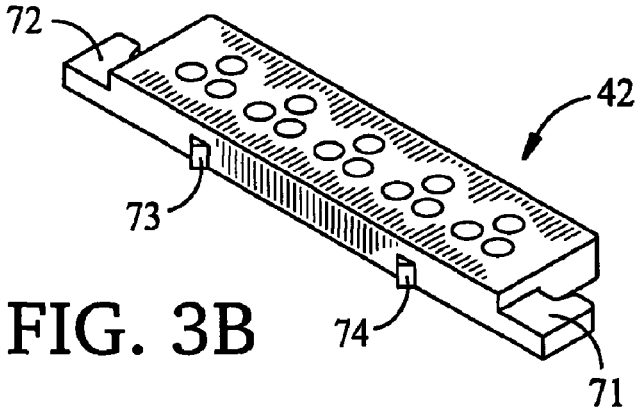
FIG. 3B is a perspective view of a plug segment.
Figure 3C:
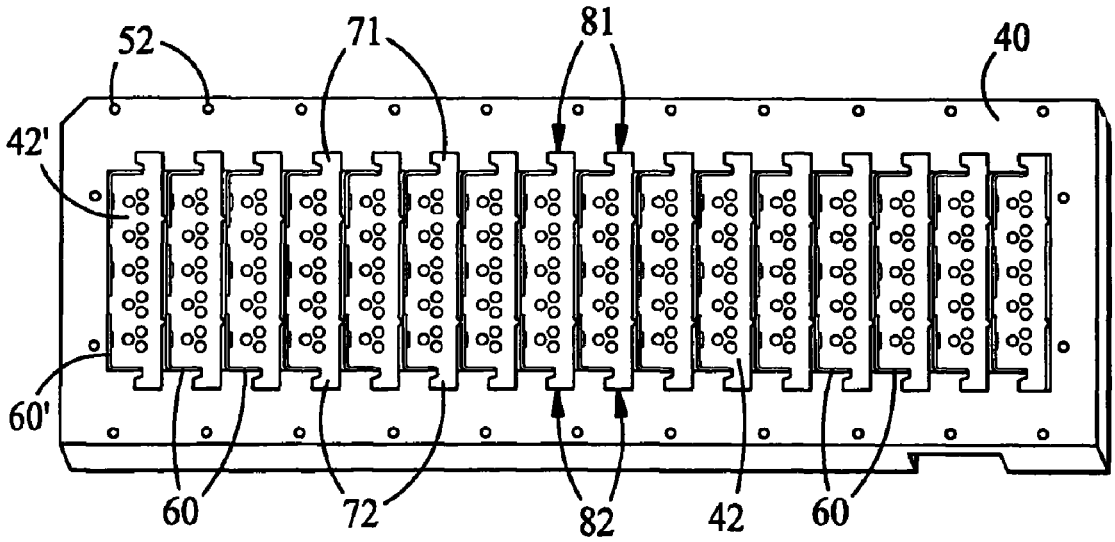
FIG. 3C is a bottom view of a plug.

Referring to FIGS. 3A-C, a shield (FIG. 3A), a segment (FIG. 3B) and the bottom surface of the plug (FIG. 3C) is shown. A shield 60 formed of electrically conductive material is located between each of the segments 42. Each shield 60 is generally U-shaped and includes two short sides 61, 62 on each side of a longer middle portion 63. When assembled into the plug, the two short sides 61, 62 of each shield 60 are in electrical contact with the frame 40, while the middle portion 63 of each shield 60 is located between each of the segments 42. Thus, the frame 40 and shields 60 form a electrically conductive "cage" around the perimeter of each segment 42. This electrically conductive "cage" is connected to the chassis ground circuit (shown in FIG. 6) of the system 10 via solder balls 52 on the bottom of the frame 40. The chassis ground circuit is a circuit within system 10 which connects to the metal structure on or in which the components of the system are mounted.

In this example, each shield 60 has four notches: two on the short sides of the shield 64, 65 and two on the middle portion of the shield 66, 67. When the shields 60 are assembled into the plug 12, the two notches on the short sides of each shield 64, 65 mate with the two dog-eared tabs 71, 72 on each corresponding segment 42. Similarly, the two notches located on the middle portion 66, 67 of each shield 60 mate with two corresponding tabs (not shown) on each segment 42. Each shield 60 also has three tabs 68 on it's middle portion 63 which are pressed in opposite directions by adjacent segments 42 after the plug 12 assembled and helps to secure the shields 60 in place.

Each segment 42 includes two dog-eared tabs 71, 72 located at each end of the segment 42. The two dog-eared tabs 71, 72 fit into two matching grooves 81, 82 formed on the bottom surface of the frame 40. The two triangular bump-outs 73, 74 on each of the segments 42 press against adjacent shields 60 and segments 42 in order to secure the segments 42 and the shields 60 within the frame 40. It should be noted that there are many ways to secure the segments 42 and shields within the frame 40 such as by glue, adhesive, cement, screws, clips, bolts, lamination or the like. The frame 40 may also be constructed by partially encapsulating the segments 42 with an electrically conductive resin or other material.

Figure 4A:
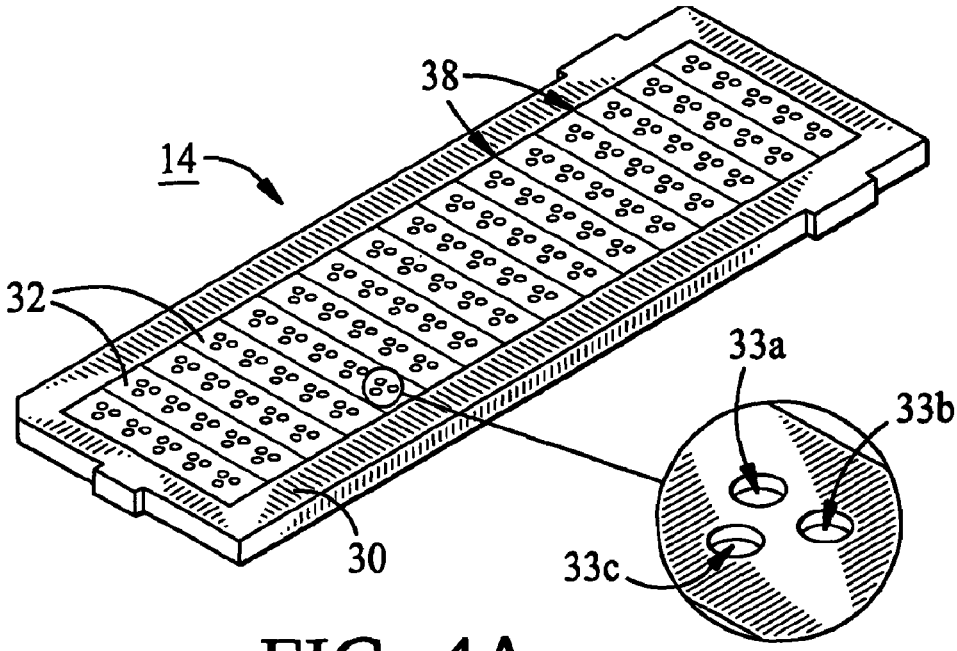
FIG. 4A is a perspective view of a socket, partially exploded.
Figure 4B:
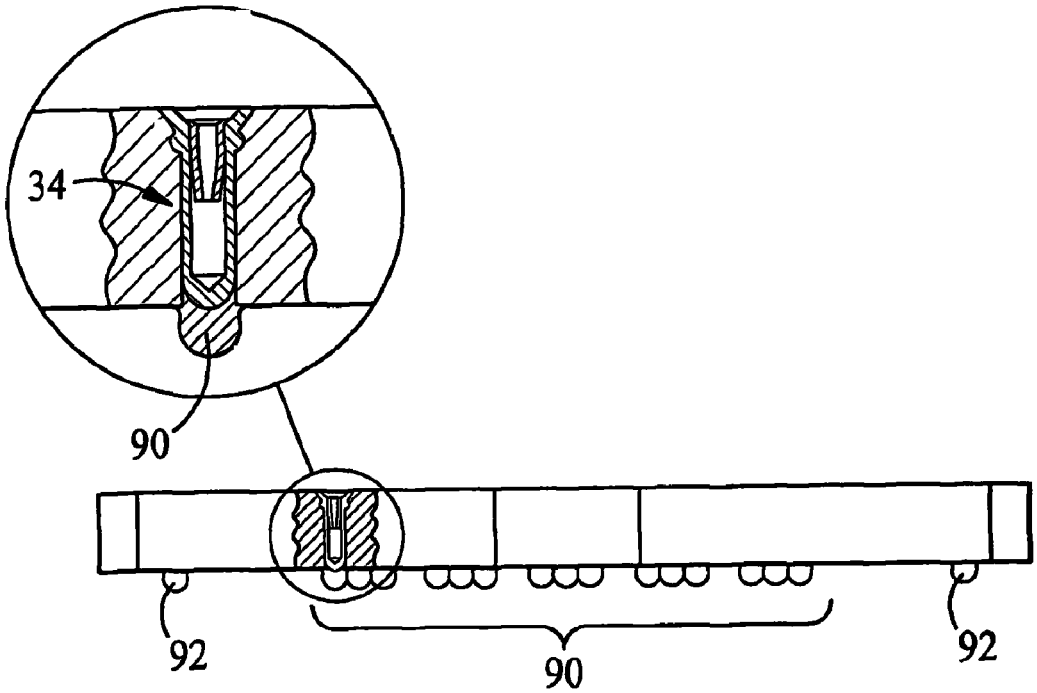
FIG. 4B is a side view of a socket, partially cut away, partially exploded.

Referring to FIGS. 4A-B, the socket 14 has an array of holes (e.g., 33*a*, 33*b*, 33*c*) disposed on the segments 32. A female socket contact 34 is disposed within each of the holes and is configured to releasably receive a corresponding male pin 44. A solder ball contact 90 is attached (e.g., by soldering) to the terminal end of each female socket contact 34 and protrudes from the bottom surface of the socket 12. The array of solder balls 90 attached to the terminal end of each female socket contact 34 may be mounted (e.g., by soldering) to contact pads located on the primary circuit board 18.

Like the plug frame 40, the socket frame 30 is formed of electrically conductive material and includes solder balls 92 attached (e.g., by soldering) to the bottom surface of the socket frame 30. When the socket 14 is mounted to the primary circuit board 18, the solder ball contacts 92 attached to the socket frame 30 are electrically connected to contact pads which are connected to the chassis ground circuit of the system 10. Additionally, when the plug 12 is inserted into the socket 14, the plug frame 40 and socket frame 30 are electrically connected to each other and are, in turn, electrically connected to the chassis ground circuit of the system 10.

Figure 5A:
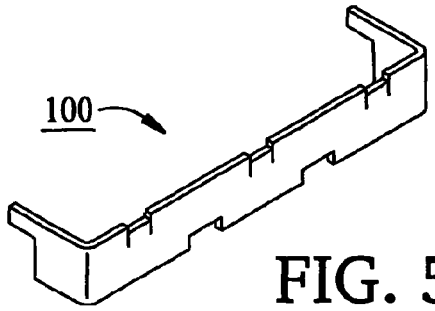
FIG. 5A is a perspective view of socket shield.
Figure 5B:
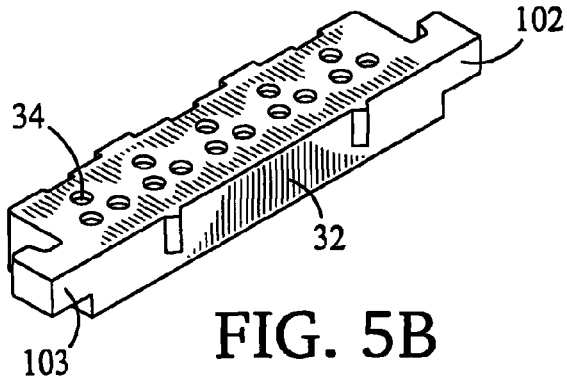
FIG. 5B is a perspective view of a socket segment.
Figure 5C:
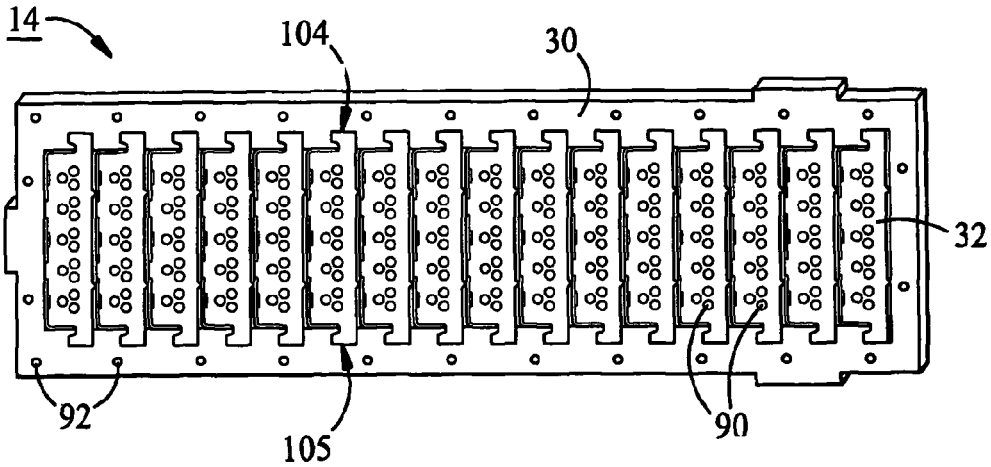
FIG. 5C is a bottom view of a socket.

As shown in FIGS. 5A-C, the assembly of the socket 14 is similar to the assembly of the plug 12 depicted in FIGS. 3A-C. Dog-eared tabs 102, 103 located on the socket segments 32 fit into corresponding notches 104, 105 disposed on the socket frame 30. A shield 100 is located between each of the segments and electrically contacts the socket frame 30, thus forming an electrically conductive "cage" around the perimeter of each socket segment 32:

The male pins 44 on the plug 12 and corresponding female socket contacts 34 disposed within the socket 14 may be any mating pair of interconnection contacts and not restricted to pin-and-socket technology. For example, other embodiments may use fork and blade, beam-on-beam, beam-on-pad, or pad-on-pad interconnection contacts. As will be explained in greater detail below, the choice of contact may effect the differential impedance of the signal channels.

Figure 6:
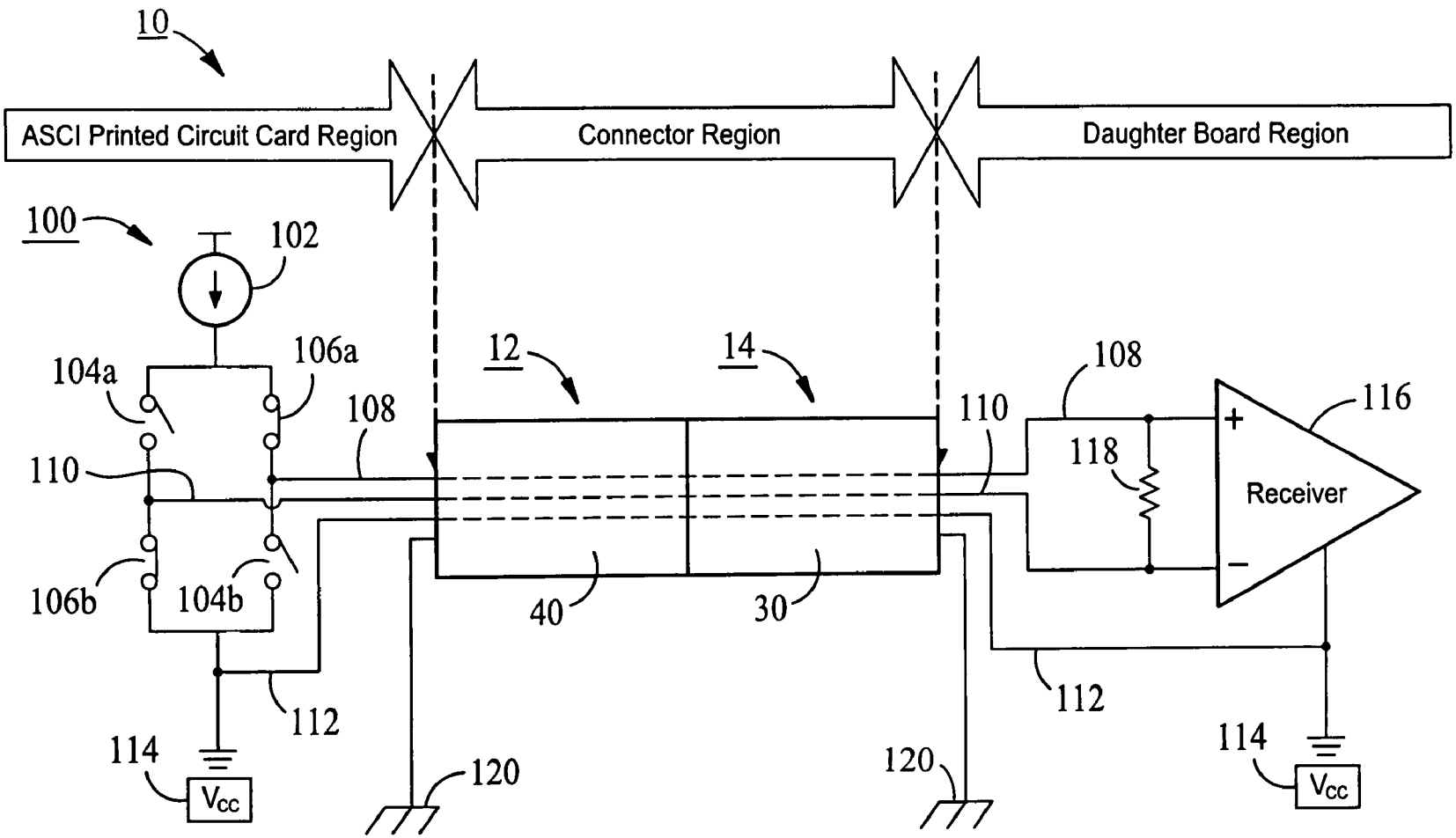
FIG. 6 is a schematic of an interconnection device in operation.

Referring to FIG. 6, in digital or analog signal transmission system 10, differential signal communication over a single three-contact grouping between secondary circuit board 16 and primary circuit board 18 is illustrated. The plug 12 mounted to the secondary circuit board 16 is plugged into the socket 14 mounted to the primary circuit board 18, forming an electrical connection between the primary and secondary circuit boards, 16, 18. Within the three-contact grouping, three male pins (not shown in FIG. 6) of the plug 12 and three corresponding female socket contacts of socket 14 couple to form a first signal channel 108, a second signal channel 110, and a reference channel 112. The first and second signal channels 108, 110 are coupled with a resistor 118 to form a symmetric differential pair transmission line. The reference channel 112 is electrically connected to the electrical ground circuit (Vcc) 114 of the system 10. The electrical ground circuit (Vcc) 114 is a circuit within system 10 that is electrically connected to the power supply (not shown) of system 10 and provides the reference ground for system 10. Additionally, the plug frame 40 and socket frame 50 are in electrical contact with each another and with the chassis ground circuit 120 of the system 10.

In this example, an ASIC chip 24 mounted to the secondary circuit board 18 includes a driver 100 which sends signals over the first and second signal channels, 108, 110. The primary circuit board 18 includes a receiver 116 which receives the signals generated by the driver 100. The receiver 116 may be incorporated within a memory device, a central processing unit (CPU), an ASIC, or another active or passive device. The receiver 116 includes a resistor 118 between the first signal channel 108 and the second signal channel 110. In order to avoid signal reflection due to mismatched impedance, the differential impedance of the first and second signal channels, 108, 110 should be such that it approximately matches the value of the resistor 118.

The driver 100 includes a current source 102 and four driver gates 104*a*-104*b*, 106*a*-106*b* and drives the differential pair line (i.e., first and second signal channels 108, 110). The receiver 116 has a high DC input impedance, so the majority of driver 100 current flows across the resistor 118, generating a voltage across the receiver 116 inputs. When driver gates 106*a*-106*b* are closed (i.e., able to conduct current) and driver gates 104*a*-104*b* are open (i.e., not able to conduct current), a positive voltage is generated across the receiver 116 inputs which may be associated with a valid "one" logic state. When the driver switches and driver gates 104*a*-104*b* are closed and driver gates 106*a*-106*b* are open, a negative voltage is generated across the receiver inputs which may be associated with a valid "zero" logic state.

The use of differential signaling creates two balanced signals propagating in opposite directions over the first and second signal channels, 108, 110. The electromagnetic field generated by current flow of the signal propagating over the first signal channel 108 is partially cancelled by the electromagnetic field generated by the current flow of the signal propagating over the second signal channel 110 once the differential signals become co-incidental or "in-line" with one another. Thus, the differential signaling reduces cross-talk between the first and second signal channels and between adjacent contact groupings.

The addition of the reference channel 112 in close proximity to the first and second channels 108, 110 functions to help bleed off the parasitic electromagnetic field to circuit ground 114, which may further reduce cross-talk between signal channels and between contact groupings.

The driver 100 may also be configured to operate in an "even" mode where two signals propagate across the first and second channel at the same time in the same direction. In this mode, current travels in the same direction over the first and second signal channels, 108 and 110, and, therefore the electromagnetic fields generated by the current flow would largely add. However, the reference channel 112 would still operate to bleed off the electromagnetic field and reduce cross-talk between adjacent contacts and contact groupings.

The socket 12 and plug 14 also feature electrically conductive "cages" formed by the frame and the shields around the perimeter of the segments, 34, 44. The plug frame 40 and socket frame 30 are in electrical contact with each other and with the chassis ground 120 of the system 10. When high speed communication takes place over an interconnection device, electromagnetic fields substantially parallel to the board are created due to the electron flow at high frequencies. The frames 30, 40 and the shields 32, 42, act as "cages" to contain the electromagnetic fields generated by the electron flow across the device, which may reduce the amount of noise emitted by the interconnection device. Additionally, the "cages" act to absorb electromagnetic fields which might otherwise be introduced into the socket 12 and plug 14, and which may adversely affect the primary or secondary circuit boards 18, 16 and any associated active or passive devices and components mounted thereto.

Referring again to FIG. 6, when a pair of interconnection devices are mated, the differential impedance for the first and second signal channels should be approximately equal to the value of resistor 118 in order to avoid reflection of the signal. In a Low Voltage Differential Signaling (LVDS) application, the value of the resistor 118 is typically 100 ohms. Thus, in a pair of interconnection devices for use in an LVDS application, the first and second signal channels should be designed such the differential impedance is approximately 100 ohms. The differential impedance of the first and second channel signal is a complex calculation that will depend on a number of variables including the characteristic impedance of the contacts, the dielectric constant of the medium surrounding the contacts, and the spatial orientation of the signal contacts and the reference ground contacts. One simplified analytical approach to determining the differential impedance, might be as follows:

TABLE I

| Dimension | Value |
|---|---|
| A | .070" |
| B | .063" |
| C | .037" |
| D | .050" |
| E | .048" |
| F | .083" |
| G | .150" |
| H | .004" |

Figure 7:
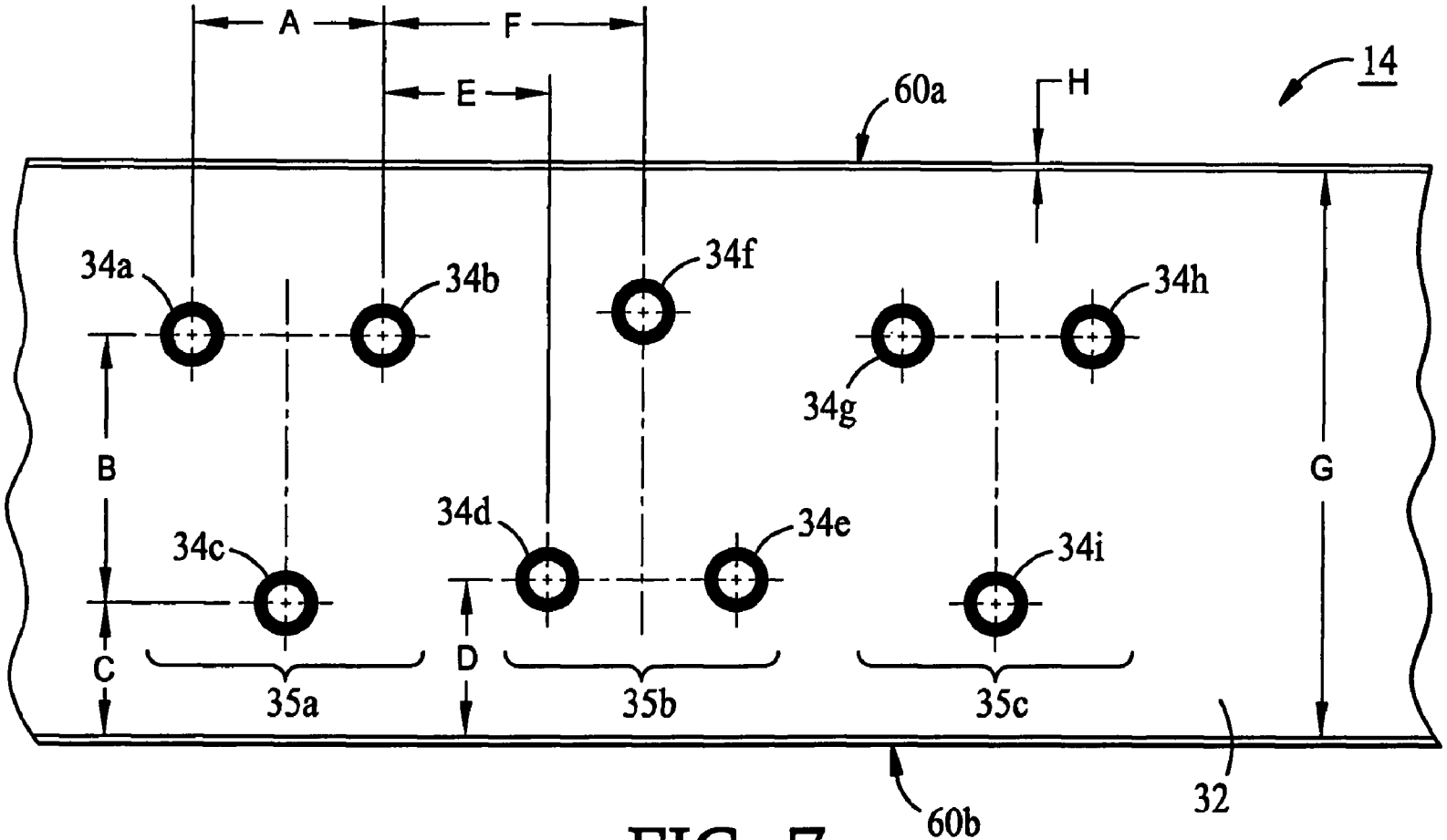
FIG. 7 is a partial view of three contact groupings within a socket.

The spatial orientation for the mating plug to socket 14 shown in FIG. 7 would have similar spacing in order to properly plug into socket 14.

The differential impedance of the differential signal channels may be adjusted by inserting material with a different dielectric constant than the segment between the differential signal contacts. For example, an air cavity (air having a dielectric constant of approximately 1) or a Teflon® insert may be inserted between the differential signal contacts in the segment in order to create a composite dielectric having a dielectric constant that is greater or less than the dielectric constant of the segment itself. This will have the effect of lowering or raising the resulting differential impedance between the differential signal contacts on the interconnection device.

The absolute value of a materials dielectric constant (Er) between adjacent conductors is inversely proportional to the resulting differential impedance between those conductors. Thus, the lower the resulting dielectric constant (Er) of a composite dielectric material b/w signal contacts, the higher the resulting differential impedance between the contacts. Similarly, the higher the resulting dielectric constant (Er) of a composite dielectric material b/w signal contacts, the lower the resulting differential impedance between the contacts.

Figure 8:
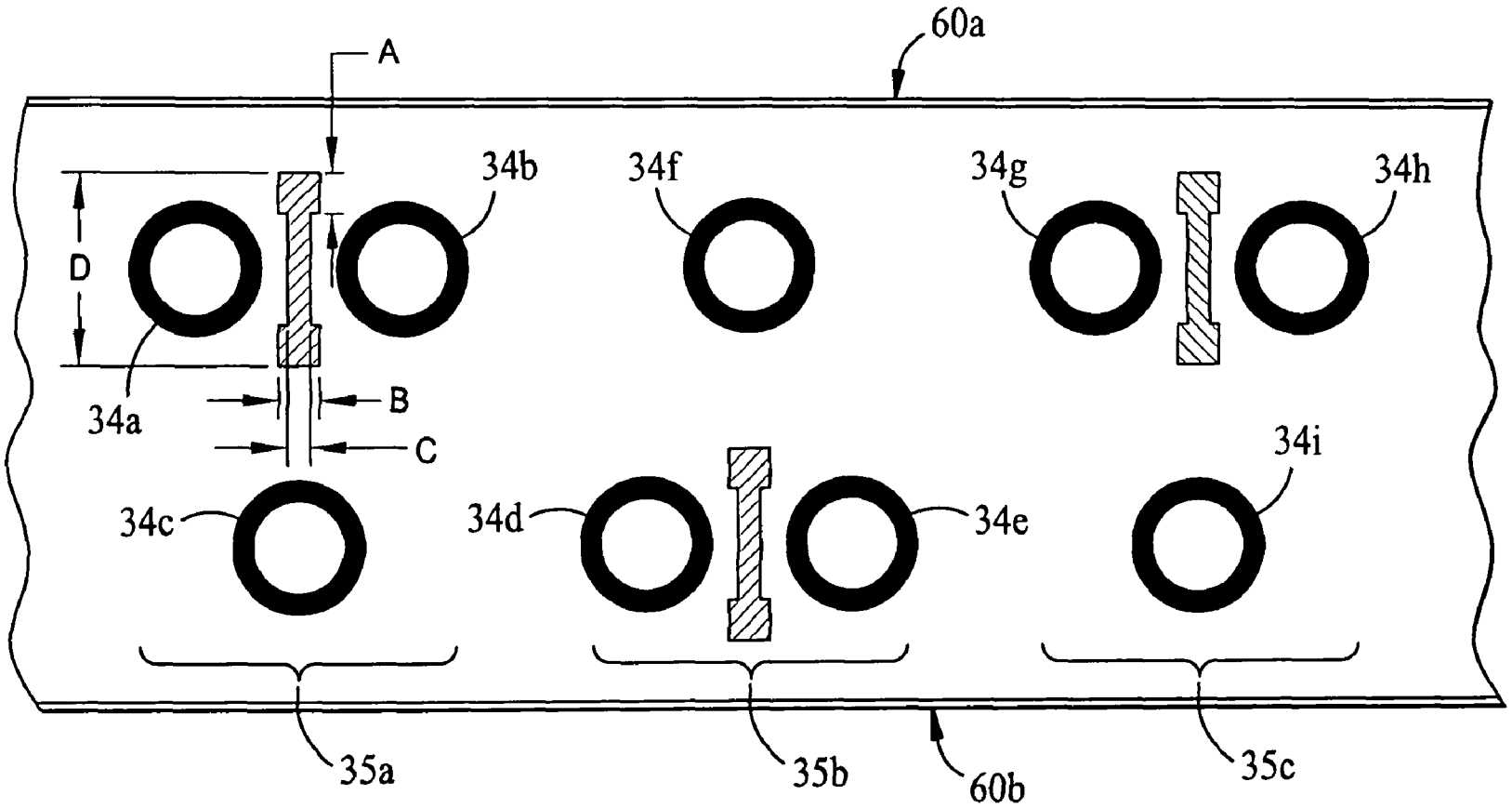
FIG. 8 is a partial view of three contact groupings within a socket and air cavities disposed on the socket.

As shown in FIG. 8, a plug 14 includes a segment 32 with three contact groupings 35*a*, 35*b*, 35*c*. Each contact grouping includes a first signal contact 34*a*, 34*d*, 34*g*, a second signal contact 34*b*, 34*e*, 34*h*, and a reference contact 34*c*, 34*f*, 34*i*. A cavity 130*a*-130*c* is formed on the segment 32 centered between the first and second signal contact of each grouping. The cavities are open to air and extends from the top surface to approximately 0.113" within the segment 32. Table II provides the dimensions of the air cavities shown in FIG. 8, given the same parameters specified in the description of FIG. 7.

(1) First determine the self inductance and self capacitance for each of the signal channels with respect to the reference channel within a unit given a selected conductor cross section and spatial relationship.

(2) Determine the differential mutual inductance and capacitance between the two signal channels within a unit given the selected conductor cross section and spatial relationship; and (3) Combine the self impedance (i.e., the self inductance plus self capacitance) and differential mutual impedance (i.e., the differential mutual inductance plus differential mutual capacitance) to approximate the differential impedance of the two signal channels.

A similar analytical approach may be used to orient the units with respect to one another. It should be noted, however, that these analytical approaches are idealized and does not account for parasitics produced in real-world transmission lines. Due to the complexity of the calculations for real-world transmission lines, computer modeling and simulations using different parameters is often an efficient way to arrange the contacts for a particular application.

Referring to FIG. 7, the spacing between the three groups of three-contact arrays 35*a*-35*c* within a segment 32 on socket 14 is shown. In this embodiment, the interconnection device 14 is adapted to be used in an LVDS application. Each contact array 35*a*-35*c* includes a pair of signal contacts, 34*a*-34*b*, 34*d*-34*e*, 34*g*-34*h*, and a reference contact 34*c*, 34*f*, 34*i*. Each of the signal contacts, 34*a*-34*b*, 34*d*-34*e*, 34*g*-34*h*, and the corresponding male pins (not shown) are formed of copper alloy and have an initial characteristic impedance of approximately 50 ohms (single-ended). The segment 32 is formed of polyphenylene sulfide (PPS) having a dielectric constant of approximately 3.2. Two shield members 60*a*, 60*b* are located adjacent to the top and bottom edge of the segment 32. Table I provides the spatial orientation between contacts within a group as well as between adjacent groups in order to produce a differential impedance in the first and second signal channels of a mated pair of interconnection devices of approximately 100 ohms.

TABLE II

| Dimension | Value |
|---|---|
| A | .021" |
| B | .021" |
| C | .011" |
| D | .0753" |

By adding this air cavity between the signal contacts in the plug 14, the differential impedance of the differential signal channels on the female side of the interconnection device is increased. The size and shape of the air cavity will depend on the desired value for the differential impedance of the differential signal channels. In an LVDS application, the desired differential impedance for the first and second signal channels formed by a mating pair of male and female contacts should be 100 Ohms, +/−5 Ohms. Thus, the female side alone may have a differential impedance of more or less than 100 Ohms and the male side may have a differential impedance of more or less than 100 Ohms, but the pair when mated have an average differential impedance of 100 Ohms (+/−5 Ohms). Male and female differential impedance values should be equal to eliminate any impedance mismatch (dissimilar impedance values) between the two. Any impedance mismatch usually results in an increased signal reflection of the applied energy back towards the signal source thereby reducing the amount of energy being transmitted through the mated connectors. The introduction of a composite dielectric as described herein can minimize the differential impedance mismatch between male and female connectors, thus minimizing reflection of the applied energy back towards the signal source, thereby increasing the amount of energy being transmitted through the mated connectors.

While an air cavity between differential signal pairs is depicted in FIG. 8, any material having a different dielectric constant than the segment may be inserted between the signal contacts on either the male or female side. For example, a Teflon® insert, air-filled glass balls, or other material having a lower dielectric constant than the material of the segment (e.g., PPS resin) may be disposed between the signal contacts in order to create a composite dielectric which reduces the resulting dielectric constant of the segment between signal contacts. Similarly, material with a higher dielectric constant may be added between the signal contacts in order to create a composite dielectric which will raise the dielectric constant of the segment between contacts.

Figure 9:
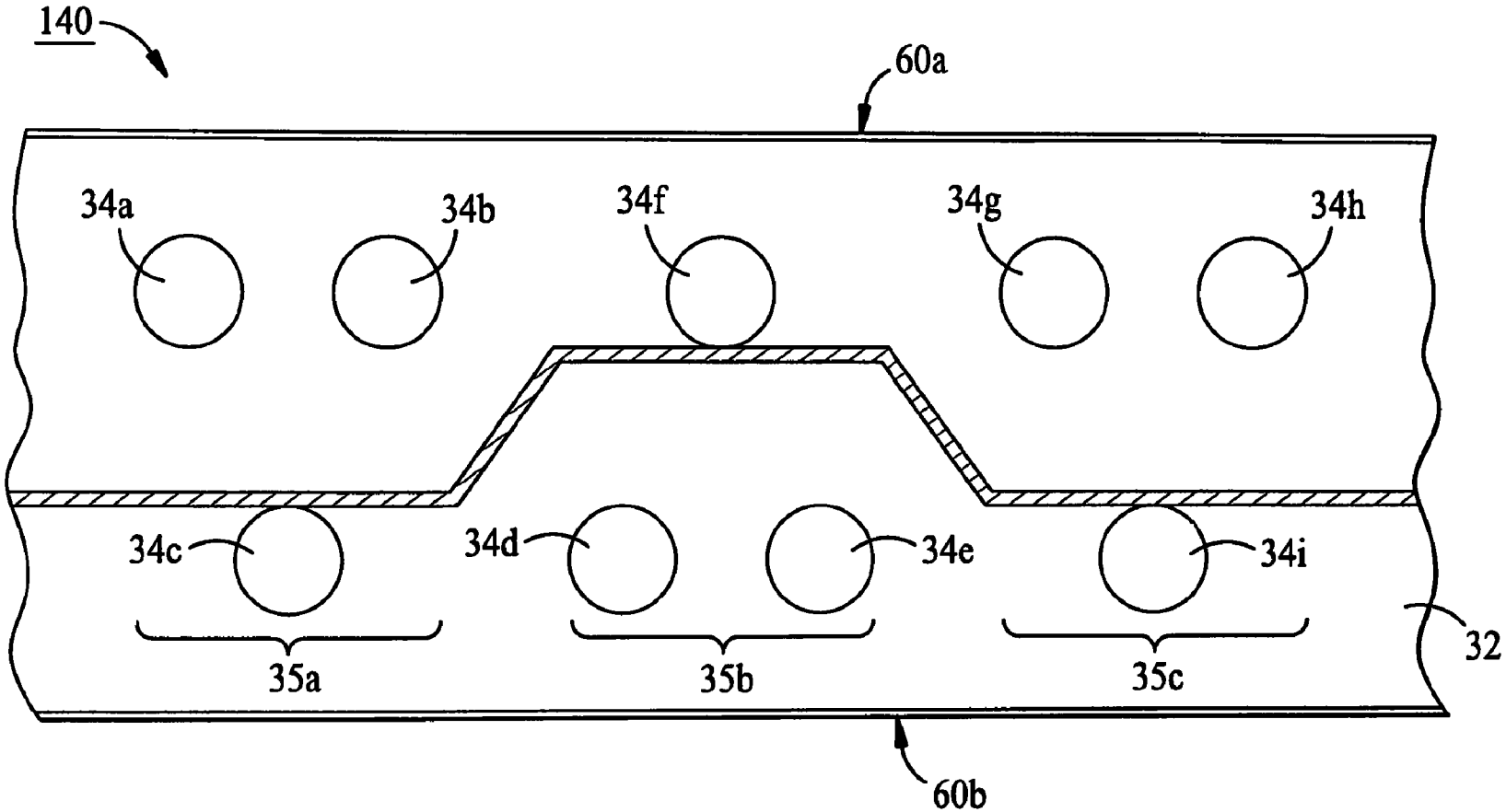
FIG. 9 is a partial view of three contact groupings and a continuous ground plane disposed within another interconnection device.

As shown in FIG. 9, another interconnection device 140 includes a segment 32 with three contact grouping 35*a*-35*c* is shown. Each contact grouping includes a pair of differential signal contacts, 34*a* and 34*b*, 34*d* and 34*e*, 34*g* and 34*h*, and a ground reference contact 34*c*, 34*f*, 34*i*. A continuous ground plane 150 is disposed within segment 32 and is in contact with each of the reference ground contacts, 34*c*, 34*f*, 34*i*. The ground plane 150 separates the differential signal contacts from each other and will have the effect of raising the differential impedance of each pair of differential signal contacts. Additionally, the ground plane 150 will further reduce cross talk between pairs of differential signal contacts by bleeding off remnant electromagnetic fields generated by electron flow across the differential signal contacts.

Figure 10:
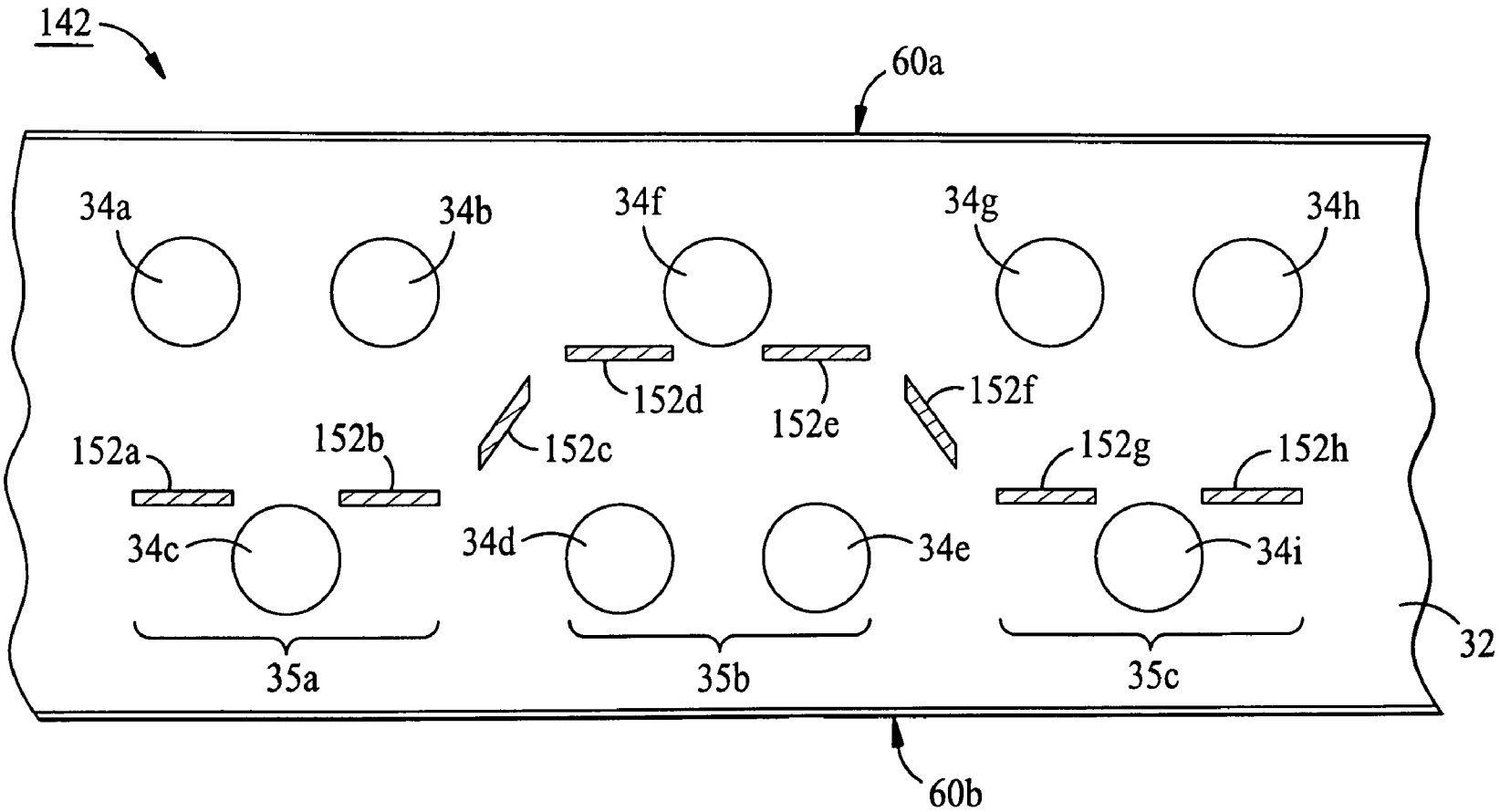
FIG. 10 is a partial view of three contact groupings and a number of ground planes disposed within another interconnection device.
Figure 11:
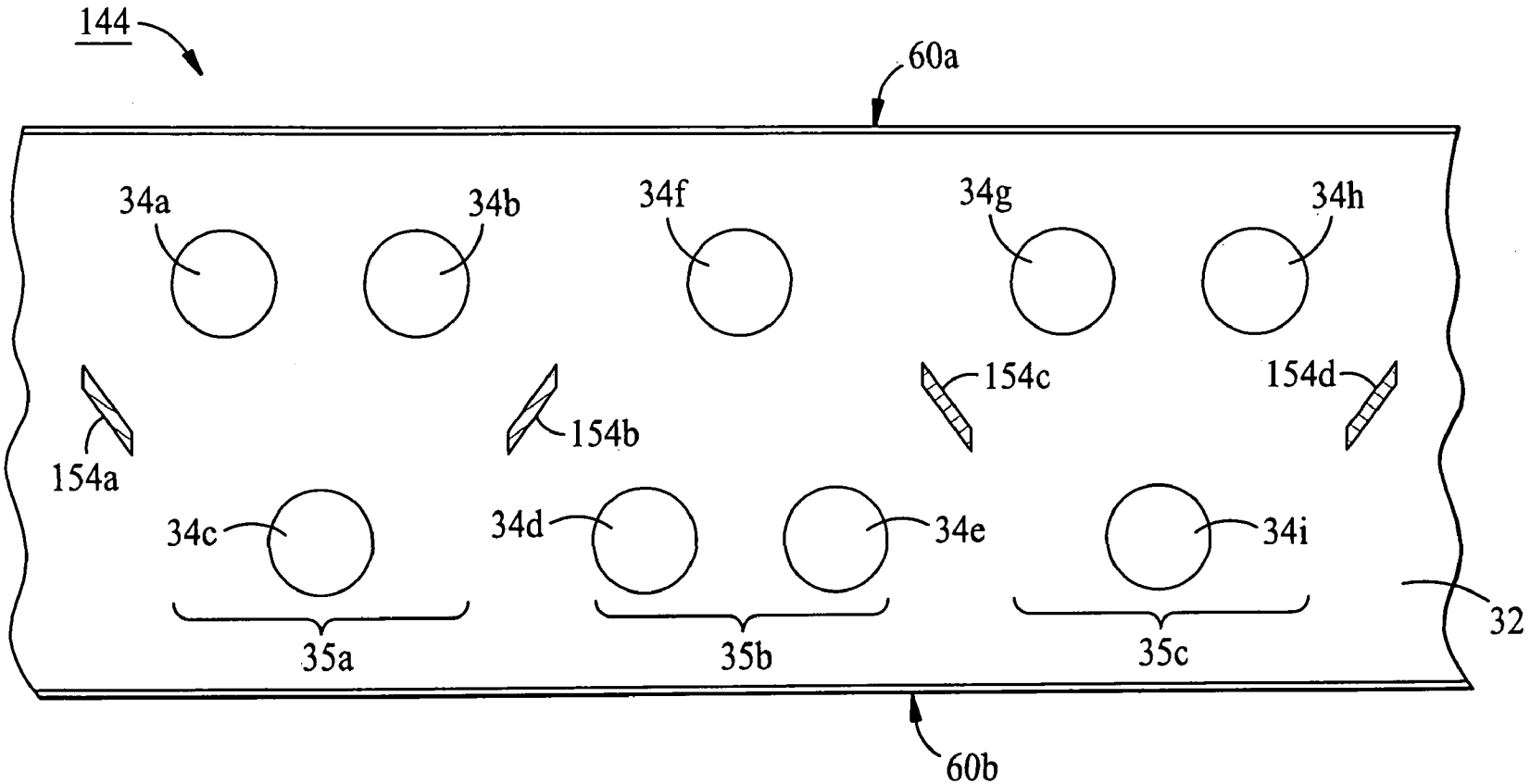
FIG. 11 is a partial view of three contact groupings and a number of ground planes disposed within another interconnection device.

As shown in FIG. 10, another interconnection devices 142 include a number of ground planes 152*a*-152*h* disposed within the segment 32. Each of the ground planes 152*a*-152*h* is configured to electrically connect with the reference ground (Vcc) of the system. Similarly, as shown in FIG. 11, another interconnection device 144 includes a number of ground planes 154*a*-154*d* which are configured to electrically connect with the reference ground of the system. Like the continuous ground plane shown in FIG. 9, the multiple ground planes illustrated in FIGS. 10-11 will effect the differential impedance of the differential signal contacts as well as further reduce cross talk between pairs of differential signal contacts.

The illustrations shown in FIGS. 1-11 show a twin-axial arrangement of differential pair contacts within a system using differential signaling. However, the technique for reducing cross-talk using a reference pin connected to ground in close proximity to one or more signal channels is not limited to systems using differential signaling, but could be used in systems using other communication techniques. For example, in a system in which individual disparate electrical signals are transmitted (e.g., single ended or point-to-point signaling), a signal contact and reference contact may be arranged in a pseudo co-axial arrangement where a signal contact and a reference contact form a contact-grouping and do not physically share a common longitudinal axis (as would a traditional co-axial transmission line), but electrically performs like a traditional co-axial transmission line. In a pseudo co-axial arrangement, the signal contact and reference contact are physically arranged such that the signal contact and the reference contact are substantially parallel to each other but do not share a common longitudinal axis. The reference contacts within the field of contacts will help to absorb electromagnetic fields generated by the signal contacts and may reduce cross-talk between single-ended transmission lines.

The examples illustrated in FIGS. 1-11 show contact groupings consisting of three contacts, a first signal contact, second signal contact and reference contact. However, contact groupings in other embodiments may include more or less than three contacts. For example, a contact grouping may include a first signal contact and second signal contact (forming differential transmission line), a third and fourth signal contact (forming second differential transmission line) and a reference contact. Additionally, in a system which uses point-to-point or single-ended signaling, a contact grouping may include one or more signal contacts and a reference contact within the contact grouping.

In whatever transmission arrangement is used (e.g., differential or single-ended), the spatial orientation of the contacts within a contact grouping can be selected such that the contacts are electrically equivalent to traditional twin-axial or coaxial wire or cable with respect to cross-sectional construction and electrical signal transmission capabilities. Additionally, the spatial relationship between adjacent contact groupings should be selected to approximate electrical isolation and preserve signal fidelity within a grouping via the reduction of electro-magnetic coupling.

The arrays of twin-axial contact grouping depicted in FIGS. 1-5 and FIGS. 7-11, are intended to match the multi-layer circuit board routing processes in order to permit the interconnection device, 12, 14, to be mounted to contact pads of printed circuit board without the need for routing with multiple Z-axis escapes as the case with traditional "uniform grid" or "interstitial grid" connector footprints. Thus, the orientation of the contacts on plug 12 and socket 14 permit it to be mounted and interconnected with the internal circuitry of a multi-layer circuit board using less layers within the circuit board than traditional connectors.

A number of embodiments of the invention have been described. Nevertheless, it will be understood that various modifications may be made without departing from the spirit and scope of the invention.

For example, the interconnection device does not need to be formed of multiple segments with shield members located between adjacent segments as illustrated in FIGS. 1-5 and 7-11. A single segment may be created around one or more shield members by forming (e.g., by injection molding) non-conductive resin or other material around one or more shield members. The frame may then be formed around the segment and the shield(s) by forming (e.g., by injection molding) a conductive resin or other material around the perimeter of the segment.

Additionally, the shield member and frame do not need to be two separate pieces. The shield and frame may consist of a one-piece construction with the segment molded or inserted within the single-piece shield-frame member.

In the illustration shown in FIG. 1, the plug and socket are releasably retained to each other by the mating array of pins and sockets and the mating of the plug and socket frames. A clip, pin, screw, bolt, or other means may be used to further secure the plug and socket to each other.

The interconnection device described herein may be used to connect any array of transmission lines in a digital or analog transmission system, such as an array of transmission lines on a printed circuit board (as illustrated in FIG. 1), an active or passive device or a cable bundle.

Accordingly, other embodiments are within the scope of the following claims.

What is claimed is:

1. An intercoupling component comprising:

a substrate formed of a non-conductive material; and plurality of electrically conductive contacts attached to the substrate;

wherein the substrate defines a plurality of cavities, each of the cavities being disposed between adjacent contacts and sized and dimensioned to adjust a differential impedance between the adjacent contacts, and wherein the substrate is formed of a material having a first dielectric constant, the intercoupling component further comprising dielectric material disposed within the cavity and having a second dielectric constant.

2. The intercoupling component of claim 1 wherein the first dielectric constant is lower than the second dielectric constant.

3. The intercoupling component of claim 1 wherein at least some of the plurality of electrically conductive contacts are adapted to transmit single-ended signals.

4. The intercoupling component of claim 1, further comprising a plurality of ground contacts each adapted to connect to a reference ground circuit of a digital or analog transmission system.

5. The intercoupling component of claim 1 wherein the plurality of electrically conductive contacts comprises two or more pair of signal contacts, each pair of signal contacts adapted to transmit differential signals.

6. The intercoupling component of claim 5 wherein at least some of the cavities are formed between each pair of signal contacts adapted to transmit differential signals.

7. The intercoupling component of claim 5, further comprising a reference ground contact grouped with each pair of signal contacts, wherein the reference ground contact is configured to electrically connect with an electrical ground circuit of a digital or analog transmission system.

8. The intercoupling component of claim 1, further comprising a frame formed of electrically conductive material disposed at least partially around one or more signal contacts, wherein the frame is adapted to electrically connect to a chassis ground circuit of a digital or analog transmission system.

9. The intercoupling component of claim 1 further comprising:

a shield member formed of electrically conductive material at least partially disposed within the substrate, wherein the shield member is configured to electrically connect with a chassis ground circuit of a digital or analog transmission system.

10. The intercoupling component of claim 9 further comprising:

a frame formed of electrically conductive material located around the signal contacts and electrically connected to the chassis ground circuit.

11. A signal transmission system comprising:

a printed circuit board; and an interconnection device coupled to the printed circuit board, the interconnection device comprising a substrate formed of a non-conductive material, and a plurality of electrically conductive contacts attached to the substrate, wherein the substrate defines a plurality of cavities, each of the cavities being disposed between adjacent contacts and sized and dimensioned to adjust a differential impedance between the adjacent contacts, and wherein the substrate is formed of a material having a first dielectric constant, the interconnection device further comprising dielectric material disposed within the cavity and having a second dielectric constant.

12. The signal transmission system of claim 11 wherein the first dielectric constant is lower than the second dielectric constant.

13. The signal transmission system of claim 11, further comprising air-filled glass spheres disposed within the cavities.

14. An intercoupling component comprising:

a substrate formed of a non-conductive material;

a plurality of groups of electrically conductive contacts attached to the substrate, each group comprising at least a pair of contacts for transmitting signals;

for each group of contacts, one or more ground planes disposed near the two contacts, the one or more ground planes being sized and dimensioned selected to adjust a differential impedance between the pair of contacts; and wherein each group of contacts comprises at least a third contact that is electrically connected to an electrical ground circuit.

15. The intercoupling component of claim 14 wherein the electrically conductive contacts comprise plugs.

16. The intercoupling component of claim 14 wherein the substrate defines holes, each of the electrically conductive contacts being disposed within one of the holes.

17. An intercoupling component for use in a digital or analog transmission system having an electrical ground circuit, the intercoupling component comprising:

a segment formed of an electrically insulative material;

a plurality of electrically conductive contacts coupled to the segment, wherein the plurality of contacts are arranged in a plurality of multi-contact groupings, at least one multi-contact grouping comprising:

a first electrically conductive contact; and a reference contact located at a distance from the first electrically conductive contact and configured to electrically connect to the electrical ground circuit of the system, and wherein the first electrically conductive contact and the reference contact form a transmission line electrically equivalent to a co-axial transmission line.

18. The intercoupling component of claim 17 wherein the reference contact is located at a distance D from the first electrically conductive contact, and each multi-contact grouping is located a distance of at least D from adjacent multi-contact groupings.

19. A system comprising:

a primary circuit board having signal lines and an electrical ground circuit;

a secondary circuit board having signal lines and an electrical ground circuit;

an interconnection device to connect the signal lines of the primary and secondary circuit boards, the interconnection device having first electrical shielding that connects to the electrical ground circuits of the primary and secondary circuit board, and a second electrical shielding that connects to a chassis ground circuit of the system.

20. The system of claim 19 wherein the interconnection device comprises a plurality of groups of pins coupled to a plurality of groups of sockets.

21. The system of claim 20 wherein the first electrical shielding comprises a reference pin in each group of pins and a reference socket in each group of sockets, the reference pins and the reference sockets being electrically connected to the electrical ground circuit.

22. The system of claim 20 wherein the second electrical shielding comprises a first electrically conductive frame disposed around the plurality of groups of pins and a second electrically conductive frame disposed around the plurality of groups sockets, the first and second frames being configured to electrically connect with the chassis ground circuit.

23. A system comprising:

a primary circuit board having a pair of signal lines that transmit differential signals;

a secondary circuit board having a pair of signal lines that receive the differential signals from the primary circuit board;

an interconnection device to connect the pairs of signal lines of the primary and secondary circuit boards, the interconnection device having a pair of pins and a corresponding pair of sockets, the pairs of pins being disposed on a first substrate, the pairs of sockets being disposed on a second substrate, and at least one of (i) the first substrate defining a cavity between the pair of pins to adjust a differential impedance of the pair of pins and (ii) the second substrate defining a cavity between the pair of sockets adjust a differential impedance of the pair of sockets, in order to match the differential impedance of the pairs of signal lines on the primary and secondary circuit boards.

24. The system of claim 23 wherein the cavity comprises an air-filled cavity.

25. The system of claim 23 wherein the cavity comprises a dielectric material-filled cavity.

26. A system comprising:

a primary circuit board having a pair of signal lines that transmit differential signals;

a secondary circuit board having a pair of signal lines that receive the differential signals from the primary circuit board;

an interconnection device to connect the pairs of signal lines of the primary and secondary circuit boards, the interconnection device having a pair of pins and a corresponding pair of sockets, the pairs of pins being disposed on a first substrate, the pairs of sockets being disposed on a second substrate, and at least one of (i) one or more ground planes between the pair of pins to adjust a differential impedance of the pair of pins and (ii) one or more ground planes between the pair of sockets adjust a differential impedance of the pair of sockets, in order to match the differential impedance of the pairs of signal lines on the primary and secondary circuit boards.

27. The system of claim 26 wherein the interconnection device has a reference pin that corresponds to the pair of pins and a reference socket that corresponds to the pair of sockets, the reference pin and the reference socket being electrically connected to an electrical ground circuit.

28. The system of claim 27 wherein at least one ground plane is coupled to at least one of the reference pin and the reference socket.

29. A method for adjusting differential impedance in a digital or analog transmission system comprising:

providing a substrate formed of a non-conductive material;

providing a plurality of groups of signal contacts attached to the substrate;

providing cavities disposed in the substrate between adjacent contacts, the cavities being sized and dimensioned to adjust a differential impedance between the adjacent contacts; and providing a dielectric material within the cavities, the dielectric material having a dielectric constant different from that of the substrate.

30. A method for adjusting differential impedances in a digital or analog transmission system, the method comprising:

providing a substrate formed of a non-conductive material;

providing a plurality of groups of signal contacts attached to the substrate, each group of signal contacts comprising at least a pair of contacts for transmitting signals;

for each pair of contacts, providing one or more ground planes disposed near the two contacts to adjust a differential impedance between the two contacts; and electrically connecting the ground planes to an electrical ground circuit.

* * * * *